United States Patent [19]

Hathaway

[11] 4,295,011

[45] Oct. 13, 1981

[54] LINEAR EXCURSION-CONSTANT INDUCTANCE LOUDSPEAKER

[75] Inventor: Dana B. Hathaway, Amesbury, Mass.

[73] Assignee: Epicure Products Inc., Newburyport, Mass.

[21] Appl. No.: 74,507

[22] Filed: Sep. 11, 1979

[51] Int. Cl.[3] ..... H04R 9/06

[52] U.S. Cl. ..... 179/115.5 VC; 179/119 R; 181/167

[58] Field of Search ..... 179/115.5 VC, 115.5 PC, 179/119 R; 181/167, 157

[56] References Cited

U.S. PATENT DOCUMENTS

| | | | |
|---|---|---|---|
| 1,953,542 | 4/1934 | Pridham | 179/115.5 VC |
| 2,727,949 | 12/1955 | Lokkesmoe | 179/115.5 VC |
| 3,160,716 | 12/1964 | Luth | 179/115.5 VC |
| 3,881,074 | 4/1975 | Kawamura | 179/119 R |

OTHER PUBLICATIONS

Molachlan, N. W. *Loud Speakers,* pp. 239–241. Dover Publications, Inc., N.Y., 1960.

*Primary Examiner*—Glen R. Swann, III
*Attorney, Agent, or Firm*—Fleit & Jacobson

[57] ABSTRACT

A loudspeaker has a focused magnetic field and a specialized voice-coil structure, which provides constant inductance at the voice coil over the entire extent of voice coil excursion. The magnetic field is focused to a thin disc and the winding of the voice coil is of a height so that it is always in view of the thin disc of the magnetic field. The voice coil winding is not more than two layers. An extended base cross-section center pole is employed having an undercut portion forming a crown at the top. The edges of the crown are chamfered to cooperate with chamfered edges on a top plate to form the thin disc of the focused magnetic field.

19 Claims, 3 Drawing Figures

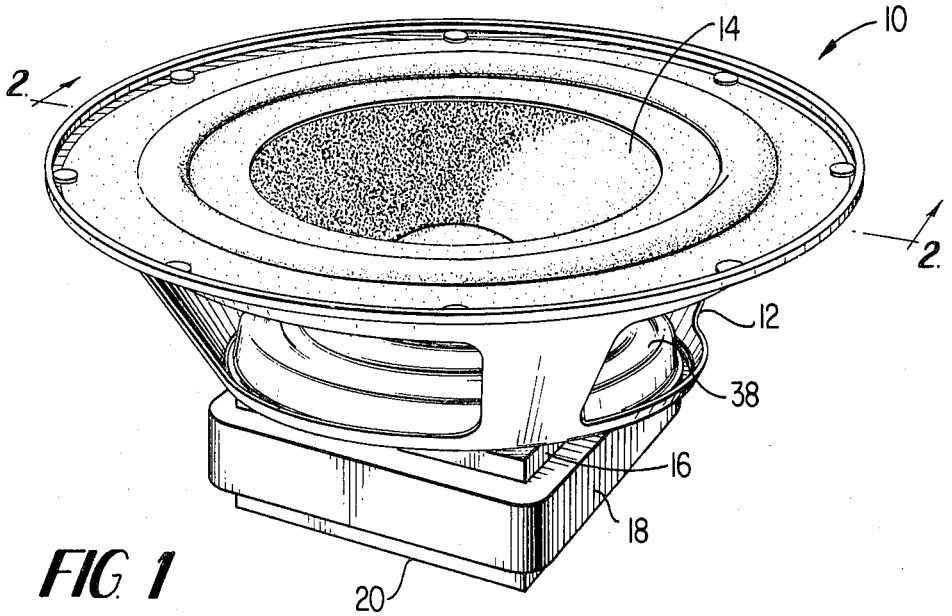
FIG. 1
FIG. 2
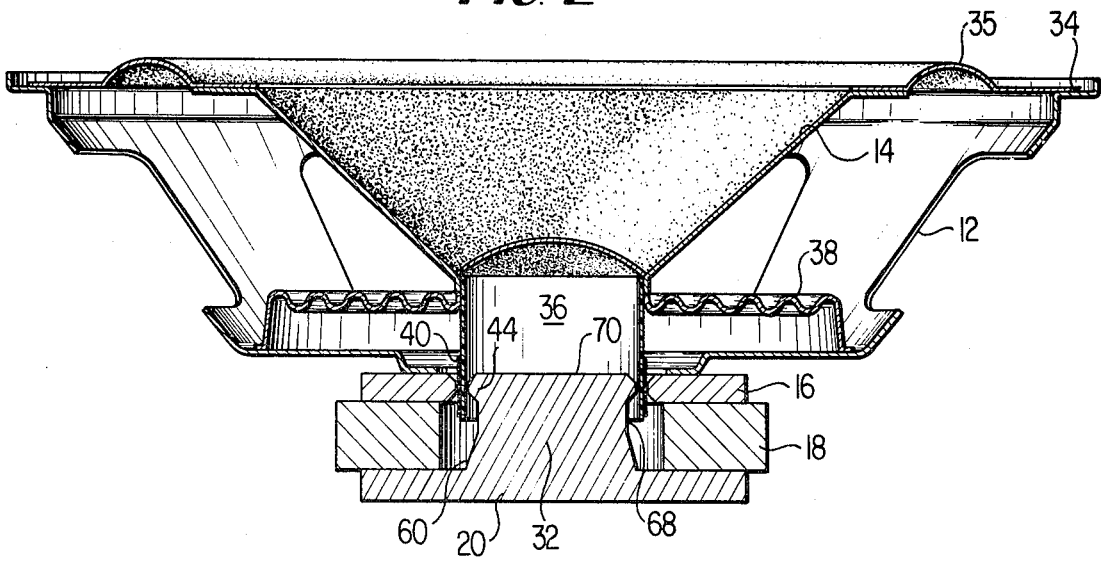

LINEAR EXCURSION-CONSTANT INDUCTANCE LOUDSPEAKER

BACKGROUND OF THE INVENTION

The present invention relates to loudspeakers and, in particular, to loudspeakers having low distortion and excellent transient response.

Recent advances in solid-state technology have resulted invastly improved tuners, turntables, tape decks, and amplifiers for use in music-reproduction systems. These improved units have required attendant corresponding improvements in loudspeakers. One of the principal requirements of modern-day loudspeakers is that they be able to handle the large amounts of audio power necessary to produce the desired sound-pressure levels. In addition to this power-handling requirement, there is the requirement that the output of the loudspeaker be a faithful reproduction of the signals originating from the music source. These system requirements pose a particularly difficult problem in the design and manufacture of low-frequency loudspeakers, i.e., woofers.

It is known that when a loudspeaker operates in the flat region of its response curve, the volume of air it must move quadruples for every octave reduction in frequency. The effect of this is that at 30 Hz a radiator or loudspeaker must vibrate with an excursion over one thousand times greater than at 1 kHz, in order to produce the same acoustic pressures. It has been shown that a 10 inch driver, having an effective radiating diameter of 20 cm and operating at 30 Hz, must move linearly over a distance of 1.5 cm, in order to produce a sound-pressure level of 105 dB at a distance of 1 meter.

Various approaches to increasing the accuracy, efficiency, and response of loudspeakers have involved employing specialized cone materials and providing specialized voice-coil arrangements, so that during maximum excursion of the voice coil, there is no opportunity for the voice coil to bottom out. The problem meets the solution head on, since one method of making a high-fidelity speaker, which can produce low frequencies with low distortion, is to use a lengthened voice coil. Obviously, a lengthened voice coil will have a greater tendency to bottom out during maximum excursion and, thereby, will have a greater tendency to clip the signal and limit the high-fidelity capabilities of the speaker. Also, it is known to produce inexpensive speakers, having high-power handling capabilities, by using a short voice coil.

Additionally, a type of dynamic drive force distortion, which can be termed "motional induction" comes into play in loudspeaker operation and has the effect of increasing the distortion and reducing the power-handling capability of a loudspeaker, by moving the effective rest point of the driver back and forth, in relation to the amplitude and frequency of the signal it is producing. In other words, because the rest position in the operating state is not at the initially designed point, the effective cone excursion is reduced, thereby causing the above-mentioned problems. Moreover, even-order distortion components are also introduced by motional inductance. Finally, second-order distortion components will be produced by the changing permeation of the magnetic field, caused by the cone and voice coil combination moving back and forth during normal operation.

Another problem associated with motional inductance is that the reactive properties of the driver or loudspeaker change instantaneously with the change in voice-coil position. It is essentially impossible to compensate for these changes in reactive properties using passive electronic components.

As indicated above, in the past, the bottoming-out problem has been overcome by the use of a relatively short voice coil. In this regard, it has been proposed to focus the magnetic field in the voice coil vicinity by chamfering the top portion of the center pole. It has also been proposed to provide an undercutting of the center pole, to form a crown at the top of the center pole. This undercutting is done in order to permit a small amount of misalignment between the voice coil and the center pole, which will prevent binding if such misalignment is present. Such misalignment permits the manufacturing tolerances to be relaxed, making assembly easier and less costly. An interesting discussion of minimizing flux leakage in the magnetic gap and minimizing the influence of axial nonuniformity of the magnetic field in the air gap is found in *Loudspeakers,* N. W. McLachlan, Dover Pub., pp 239–241, (1960).

SUMMARY OF THE INVENTION

The present invention provides a low distortion, high transient-response loudspeaker, having an expanded base cross-section center pole and a specialized voice coil-center pole construction, which serves to eliminate the adverse effects of motional inductance. More specifically, the inventive loudspeaker employs a high-density focused magnetic field, a low-inductance, lightweight, voice coil, and a stiff heavy-felted, low-vacuum deposition cone structure. The present invention provides a loudspeaker which is linear in its response and which provides a constant inductance over the entire extent of voice coil excursion. The magnetic field in the voice-coil region is focused by forming the center pole with a crown having two chamfered edges, which interact with a top plate, which is also provided with chamfered edges on the inner diameter of its central aperture. By focusing the magnetic field in this manner, the magnetic circuit is optimized and the motional components of the motional inductance are effectively eliminated.

The present invention provides a high-density focused magnetic field, which operates to focus the magnetic field over a short axial length, which provides greater linearity of the axial magnetic-field gradient, and which prevents lower leakage of flux lines bypassing the magnetic gap. Utilization of these inventive features permits the loudspeaker to use a shorter axial-length voice coil without sacrificing the linearity of the forces applied to the diaphragm, i.e., the cone structure. Such forces applied to the diaphragm are made extremely linear by means of the focusing of the axial magnetic-field strength. Accordingly, the electrodynamic efficiency of the inventive loudspeaker is increased, due to the lowering of the flux leakage around the magnetic gap. It should be noted that lowering the moving mass by decreasing the length of the voice coil also aids in providing the desired linearity.

Additionally, as will be explained hereinbelow, a decrease in the static and dynamic induction of the voice coil is also provided by the present invention. The effect of lowering these inductances is to reduce the DC component of the motional-inductance forces applied to the diaphragm. This substantially reduces distortion and increases the power-handling capabilities over previously-known loudspeakers. The lowering of the static inductance also presents an electrical load to the amplifier that is more purely resistive and, therefore, easier to drive.

In regard to the limitations on linear excursion in the loudspeaker caused by motional inductance, it has been known for quite a while that this is an inherent nonlinearity in the magnetic system and results in nonlinear distortion in dynamic loudspeakers. Applicant has discovered that this problem is somewhat analogous to the generation of back emf in electric motors. Moreover, it has been found that unless the entire system is magnetically saturated, the motion of the voice coil against the iron structure will generate an additional current in the voice coil. This additional current has both a DC component and a component at the second harmonic of the driving signal. Both of these components generate substantial second-harmonic distortion. This may be seen since the motion of a current-carrying conductor against another ferromagnetic material will produce a space rate of change in the self inductance of the conductor, as it moves with respect to the field structure. This is represented mathematically by the following.

The expression describing the force on the voice coil against a steady magnetic field is $$F=B\cdot L\cdot I$$

where:

B=flux density,

L=length of the conductor cutting the flux, and

I=current through the conductor.

If the field is saturated, then this expression completely describes the forces involved.

However, if the field is not saturated, there is another force present that is proportional to the change in the dynamic inductance caused by the motion of the voice coil. This force may be expressed as:

$$F=\tfrac{1}{2}I^2(dL)/(dX)$$

Now if a current I cos ωt is caused to flow in the coil, then the two force equations are:

$$F1=BLI\cos\omega t;$$
$$F2=\tfrac{1}{2}(I\cos\omega t)^2(dL)/(dX)$$

The sum of the forces on the coil is the sum of these two expressions. Thus, by utilizing the trigonometric identity $\cos^2\omega t=\frac{1}{2}(1+\cos 2\omega t)$ and substituting into the sum of $F_1$ plus $F_2$, we have the quantity:

$$F=BLI\cos\omega t+\tfrac{1}{4}I^2(1+\cos 2\omega t)(dL)/(dx)$$

In identifying each of these terms, it may be seen that a force on the voice coil having the frequency of the tone is present and is represented by BLI cos ωt. Also, a force is present on the voice coil at a DC level, which is proportional to $I^2$ (dL/dX). Finally, a force is present on the voice coil at the second harmonic of the tone cos 2ωt, which is also proportional to $I^2$ (dL/dX). This means that the dynamic inductance of a woofer or loudspeaker, expressed in terms of dL/dX, produces a DC component or a motional offset of the voice coil and the speaker cone, as well as a second-harmonic distortion. This offset will cause the voice coil and cone to be displaced by a fixed amount from the "rest position". This displacement then reduces the overall length of the symmetrical excursion region and ultimately limits the power-handling capability of the loudspeaker.

Applicant has discovered that by lowering the overall inductance of the coil, the quantity dL/dX is also reduced. However, this will not solve all of the problems, since such reduction of dL/dX will severely reduce the efficiency of the loudspeaker. Applicant's next move was to increase significantly the flux density in the magnetic gap at the voice coil, so that efficiency would be resorted and so that the iron structure would be brought closer to saturation. As shown above, total saturation has the effect of eliminating the DC component altogether.

Following this approach, several other benefits are obtained, for example, a reduced overall inductance serves to extend the driver's electronic cutoff to higher frequencies and, thereby, allows a heavier-felted cone to reduce flexing of the cone structure. Also, the reduced value of dL/dX, i.e., the dynamic inductance, will present a load to the amplifier which is much easier to drive than a high-inductance load. To attain this reduction in dynamic inductance, the present invention provides a low-inductance, two-layer voice coil having a two-inch diameter and operating in conjunction with a focused-field, soft-steel pole piece and specially constructed top plate, which cooperate to concentrate the flux in an extremely small gap.

Therefore, it is an object of the present invention to provide a loudspeaker having a low distortion and excellent transient response and which eliminates the adverse effects caused by the motional inductance of the voice coil.

It is another object of the present invention to provide a loudspeaker, wherein the magnetic flux in the gap is concentrated by means of a focused magnetic field.

It is still another object of the present invention to provide a loudspeaker having a voice coil which has a short length, relative to its required maximum excursion.

It is a further object of the present invention to provide a loudspeaker having a low-inductance, lightweight voice coil.

It is still a further object of the present invention to provide a focused magnetic field by means of a specially-constructed, chamfered-edge center pole cooperating with a chamfered top plate.

It is another object of the present invention to provide a loudspeaker having a stiff, heavy-felted cone structure.

It is also an object of the present invention to eliminate dynamic inductance to provide a speaker having an essentially linear response and increased linear excursion power handling.

The manner in which these and other objects are accomplished by the present invention will become evident from the following detailed description.

BRIEF DESCRIPTION OF THE DRAWINGS

FIG. 1 is a perspective of the inventive loudspeaker;

FIG. 2 is a cross-sectional view taken along line 2—2 in FIG. 1.

DETAILED DESCRIPTION OF THE INVENTION

Figure 3:
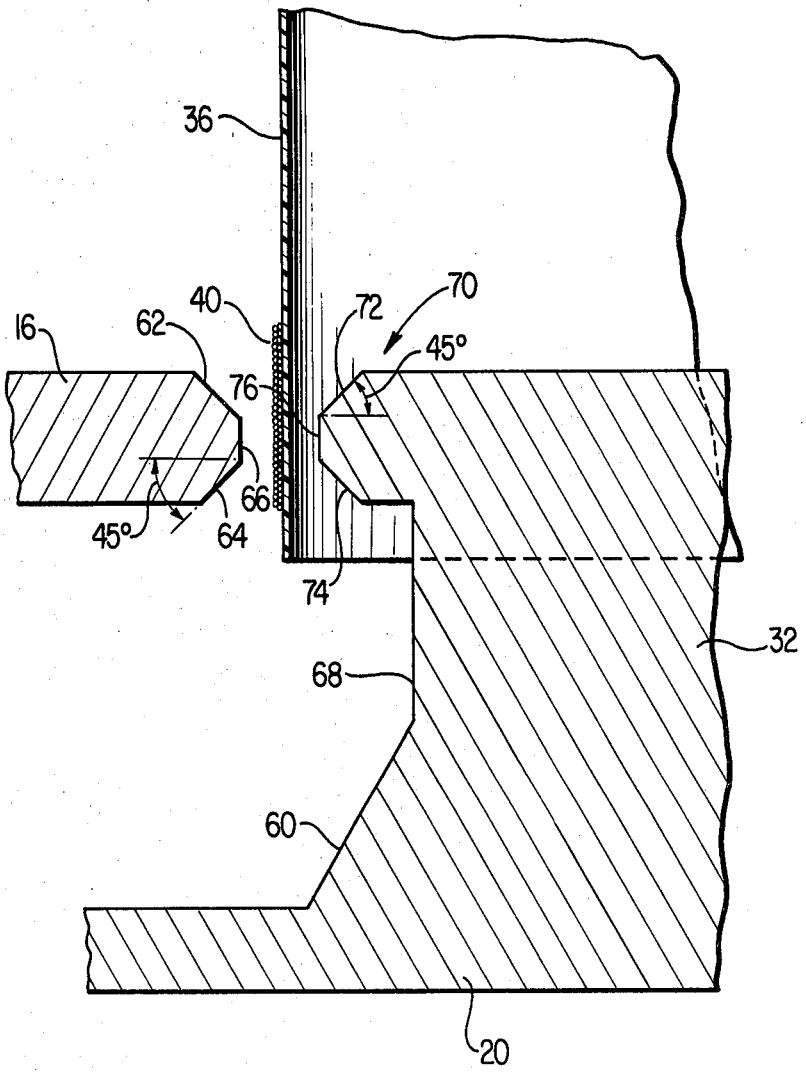
FIG. 3 is a detail of a portion of FIG. 2, showing the focused magnetic field.

Referring to FIG. 1, the inventive focused-field acoustic transducer is shown in perspective. The basket 12, which serves as the frame for the speaker, as well as providing an upper support surface for the speaker cone 14, has the top plate 16 of the focused magnetic field system attached to its lower surface. The ferrite magnet 18, which provides the magnetic field, is sandwiched between the top plate 16 and a bottom plate 20. Because the present invention relates to the apparatus for focusing the magnetic field, in conjunction with an inventive voice coil, in order to eliminate the adverse effects of motional inductance, it is necessary to see inside the speaker 10. In this regard, FIG. 2 is a cross-sectional view of the speaker of FIG. 1 taken along lines 2—2.

In FIG. 2, the top plate 16 is arranged concentrically with the magnet 18 and the bottom plate 20. The bottom plate 20 is formed with an expanded base cross-section center pole 32. The cone 14 is affixed to the top rim of the basket 12 at 34 by means of a surround 35. The cone 14 is attached at its truncated apex to the voice coil 36. The voice coil 36 is suspended concentrically with the basket 12 and the magnetic system, 16, 18, and 20, by means of a spider 38. The spider 38 is formed having a much larger diameter than is normally found in conventional loudspeakers. Similarly, the voice coil is of a relatively large diameter compared to conventional voice coils and is provided with a winding 40, which is wound with only two layers. The present voice coil 36 is formed having a diameter of two inches. By using a two-layer winding 40, both the static and dynamic inductance of the voice coil 36 were reduced. As indicated above, it is the focused field that permits the use of this lightweight low-inductance coil.

The top plate 16, which is attached to the basket 12 by welding or the like, is provided with a central circular aperture, and both edges of this aperture are chamfered. This chamfering may be seen more clearly in FIG. 3. Additionally, the extended center pole piece 32 is undercut so as to form a crown 44 at the top of the pole piece, and both edges of the outer diameter of the crown 44 are also chamfered.

As described above, a principal drawback in loudspeaker design, which acts to limit the power-handling capability of the speaker, is the restriction on the extent of travel of the voice coil. In this regard, it may be seen that the voice coil 36 can travel a large distance without bottoming out, i.e., without abutting the bottom plate 20. However, because the inventive loudspeaker provides an essentially linear speaker, wherein the inductance presented by the voice coil 36 is a constant regardless of its displacement, the center pole 32, the top plate 16, and the voice coil 36 are all specially formed; this will be seen in more detail in FIG. 3. In regard to the voice coil 36, because it is required to be exceptionally dimensionally stable, the typical form, e.g., Nomex, has proven to be unacceptable. Moreover, it has been found that using aluminum, which is very stable dimensionally, for the form causes an additional problem. That is, because aluminum is slightly permeable it will get into the magnetic circuit and reduce the magnetic flux, thereby slowing down the voice coil. This addition to the magnetic circuit of the aluminum form may be termed the "shorted-turn" effect. Therefore, an extremely temperature-stable non-metallic film, such as a polymide film, Kapton, is required. As indicated above, the voice coil 36 is sufficiently short so that the maximum excursion of the cone 14 will not cause the voice coil to bottom out. As explained above, were nothing more provided, the short voice coil standing alone would seriously limit the power-handling capabilities of the speaker. However, the present invention provides a special magnetic field system to solve this problem.

Turning now to FIG. 3, which is an enlarged detail of a portion of the cross-sectional view of FIG. 2, it may be seen that the center pole 32 is provided with a tapered increased-diameter portion 60, at the bottom where it meets the bottom plate 20. This increased diameter serves to increase the mass of metal available for the extended center pole, thereby bringing the pole closer to magnetic saturation and reducing the unwanted DC component of motional inductance, as discussed above.

In FIG. 3, the relationship between the top plate 16, the center pole 32, and the voice coil 36 may be seen in more detail. The specific dimensions of the voice coil 36, the top plate 16, and extended pole 32 are chosen such that only a small gap is formed and so that the inductance among these three elements is a constant, independent of the voice-coil position. In other words, because of the shape and size of the voice coil 36, as it moves in and out of the specially formed gap between the top plate 16 and center pole 32, the voice-coil inductance is constant.

The inner diameter of the circular aperture formed in the top plate 16 is provided with chamfered upper and lower edges, 62 and 64, respectively, thereby forming an inner-annular planar surface 66. Applicant has found that these chamfered surfaces, 62 and 64, may have a chamfer angle of between 45° and 60°. When the chamfer angle is above 60°, a saturation problem is present and, when the chamfer angle is less than 45°, there are inductance problems. This is the dynamic inductance, which is related to the offset problem discussed above.

The center pole 32 is provided with an undercut portion, i.e., a portion of decreased diameter, shown typically at 68. This undercut 68 produces a crown portion 70 on the top of the center pole 32 and the crown portion has a top chamfered edge 72, a bottom chamfered edge 74, and an annular planar surface 76, which is arranged opposite and parallel to the annular planar surfce 66 of the top plate 16. It has been found through experimentation that the annular planar surfaces 66 and 76 should have a height of approximately 0.15 inches.

The voice coil 36, having the winding 40, is disposed between these two annular planar surfaces, 66 and 76, and is suspended in the position shown by the action of the spider 38 and the cone 14 of FIG. 2. In order to provide optimum excursion of the speaker cone 14, the winding 40 must be of a relatively short height. The height of two-layer winding 40 of coil 36 is only approximately ½ inch. By arranging the elements as shown in FIG. 3, it is possible to provide a constant inductance, since the winding 40 sees a thin metal disc, as represented by the planar surfaces 66 and 76. In a conventional speaker the voice coil winding would see a metallic cylinder, instead of a narrow disc of thickness approximately equal to 0.15 inches.

Therefore, it may be seen from the above description that the present invention provides an arrangement of elements which produce a constant inductance in the voice coil, when it moves in the magnetic gap, due to the fact that the voice coil moves around a center pole which is geometrically and electromagnetically designed as a disk, in place of the cylinder found in conventional designs. The resulting constant inductance of the voice coil, as it moves in the gap, eliminates the "motional offset" and harmonic distortion, which are both common to conventional designs, and increases the symmetrical excursion capability, i.e., low-frequency power handling of the inventive loudspeaker.

It is understood that the foregoing is presented by way of example only and is not intended to limit the scope of the present invention, except as set forth in the appended claims.

What is claimed is:

1. A loudspeaker, comprising:

a frame, a speaker cone attached at its widest portion to the frame, a hollow cylindrical voice coil attached to the narrow portion of the cone and having a winding formed on the end of the voice coil distal said cone, said winding having no more than two layers and forming a coil, and means attached to said frame for generating a focused magnetic field, said field being formed to surround said voice coil and being focused onto said coil winding, said focused magnetic field being formed as a cylinder having a height less than the height of said winding;

said means for generating said focused magnetic field comprising a center pole extending upwards inside of said hollow voice coil, and a bottom plate affixed to said center pole at an end thereof distal from said hollow voice coil, said center pole having a midsection and a portion of gradually increasing diameter, said diameter gradually increasing from said midsection through said portion of gradually increasing diameter to said end of said center pole distal said hollow voice coil, whereby to add increased magnetizable mass to said center pole.

2. The loudspeaker of claim 1, wherein said means for generating a focused magnetic field further comprises:

a top plate affixed to said frame and having a circular aperture for accommodating said voice coil, the upper and lower edges of said aperture being chamfered to form a first cylindrical planar surface, and a magnet arranged adjacent to and aligned with said top plate and having a circular aperture for accommodating said voice coil, said bottom plate being adjacent said magnet and arranged opposite said top plate, said center pole having a crown portion at the top of said center pole, said midsection being of decreased diameter relative to the diameter of said crown portion at the top of said center pole, said crown portion being formed having chamfered top and bottom outer circumferential edges to form a second cylindrical planar surface opposite said first cylindrical planar surface, said first and second cylindrical planar surfaces having a height less than the height of said winding and being concentrically aligned with said winding such that a portion of said winding remains concentrically aligned with said first and second cylindrical surfaces during the extent of excursion of said voice coil.

3. The loudspeaker of claim 2, wherein said crown portion has a diameter, and said center pole at said end distal said voice coil has a diameter equal to the diameter of said crown portion.

4. The loudspeaker of claim 2, wherein said first and second cylindrical surfaces have a height of 0.150 inches.

5. The loudspeaker of claim 2, wherein said chamfered edges of said top plate and said chamfered edges of said crown are formed having an angle of 45° with respect to a horizontal reference line.

6. The loudspeaker of claim 2, wherein said center pole is formed having a length such that said bottom plate is located a predetermined distance from said first and second cylindrical surfaces, and wherein said coil winding is located on said voice coil such that the portion of voice coil extending below said coil winding plus the maximum extent of voice coil excursion is less than said predetermined distance.

7. The loudspeaker of claim 1, further comprising a circular supporting means having a central aperture with said voice coil and said speaker cone affixed therein, and the outer circumference of said supporting means abutting said frame for supporting said voice coil and said winding in said magnetic field.

8. The loudspeaker of claim 1, wherein said voice coil is two inches in diameter.

9. The loudspeaker of claim 1, wherein said voice coil is a cylinder formed of a polymide film.

10. The loudspeaker of claim 1, wherein said winding has a height of ½ inch.

11. An improved loudspeaker, comprising:

a voice coil, means for producing a magnetic field, and means for focusing the magnetic field so as to form an intensified cylindrical magnetic field, said voice coil being formed with no more than two layers of coil windings thereon, said coil windings being of a height on said voice coil which is large compared to the height of said cylindrical magnetic field;

wherein said means for focusing said magnetic field comprises a center pole piece having a middle portion, and a bottom plate affixed to an end of said center pole piece distal said voice coil, said center pole piece having a portion of gradually increasing diameter, said diameter increasing from said middle portion through said portion of gradually increasing diameter to said end of said center pole piece distal said voice coil, whereby to add increased magnetizable mass to said center pole piece.

12. The loudspeaker of claim 11, wherein said center pole piece has a reduced diameter at said middle portion, and includes an upper crown portion having a diameter larger than said reduced diameter of sad middle portion, said crown portion being formed with the upper and lower edges chamfered to form a first thin cylindrical planar surface, said means for focusing said magnetic field including a top plate having a central circular aperture therein arranged surrounding said crown for closing the magnetic circuit, wherein said aperture is formed with chamfered upper and lower edges, thereby defining a second thin cylindrical planar surface, said first and second thin cylindrical planar surfaces being of a height which is less than the height of said voice coil windings.

13. The loudspeaker of claim 12, wherein said center pole piece at said end distal said coil has a diameter equal to the diameter of said upper crown portion.

14. The loudspeaker of claim 12, wherein said first and second thin cylindrical planar surfaces have a height of 0.150 inches.

15. The loudspeaker of claim 12, wherein said upper and lower edges of said crown portion of said center pole piece and chamfered at an angle of 45° in relation to a horizontal reference line.

16. The loudspeaker of claim 12, wherein said upper and lower edges of said central aperture of said top plate are chamfered at an angle of 45° in relation to a horizontal reference line.

17. The loudspeaker of claim 11, wherein said voice coil is formed having a diameter equal to 2 inches.

18. The loudspeaker of claim 11, wherein said no more than two layers of coil windings comprises two layers of coil windings and the voice coil is formed having said two layers of coil windings concentrically wound on a hollow cylinder.

19. The loudspeaker of claim 11, wherein said no more than two layers of coil windings comprises two layers of coil windings and said height of said two layers of coil windings on said voice coil equals $\frac{1}{2}$ inch.

* * * * *